United States Patent [19]

Coppock

[11] 4,302,861

[45] Dec. 1, 1981

[54] METHOD OF MAKING A SHOE BUILDUP

[76] Inventor: Earl E. Coppock, 415 W. 1st St., Marion, Ind. 46952

[21] Appl. No.: 136,371

[22] Filed: Apr. 1, 1980

[51] Int. Cl.[3] ..... A43D 9/00; A43B 3/12; A43B 13/12

[52] U.S. Cl. ..... 12/142 S; 12/142 RS; 12/146 BR; 36/11.5; 36/30 R

[58] Field of Search ..... 12/142 R, 142 E, 142 S, 12/142 RS, 142 T, 146 B, 146 BR; 36/11.5, 14, 30 R, 44, 32 R, 9

[56] References Cited

U.S. PATENT DOCUMENTS

| | | | |
|---|---|---|---|
| 2,173,702 | 9/1939 | Winkel | 36/11.5 |
| 2,426,671 | 9/1947 | Crepeau | 36/30 R |
| 2,581,524 | 1/1952 | Ford | 12/142 R |
| 2,663,097 | 12/1953 | Giese, Jr. | 36/9 |
| 2,845,640 | 8/1958 | Murray | 12/146 BR |
| 3,821,135 | 6/1974 | King | 36/30 R |
| 4,104,754 | 8/1978 | Almao | 12/142 S |
| 4,151,661 | 5/1979 | Namba et al. | 36/30 R |

*Primary Examiner*—Patrick D. Lawson

*Attorney, Agent, or Firm*—Albert L. Jeffers; John F. Hoffman

[57] ABSTRACT

A shoe buildup and a method for making the same wherein a block of rigid foam material is cut and shaped to follow the contour of an existing shoe and is then preferably adhesively secured to the sole of the shoe. Although the buildup may be formed of one piece, it is generally formed in two parts, one for the front portion of the shoe and one for the heel portion thereof. After the buildups have been attached, a ground engaging second sole and a heel are nailed to the bottoms of the buildups. Side coverings of leather or other appropriate material may be adhesively secured to the front and rear buildups to provide a finished shoe having an attractive appearance.

7 Claims, 8 Drawing Figures

METHOD OF MAKING A SHOE BUILDUP

BACKGROUND OF THE INVENTION

The present invention relates to shoe constructions and the manufacture thereof, and in particular to buildups for shoes.

In order to increase the effective height of shoes whereby the level at which the foot is supported is higher than normal, it is known to construct an extension of the half sole and heel, which are generally adhesively secured to the existing sole of the shoe, and then attach a ground engaging second sole and a heel, which are made of leather or another suitable material such as nylon, to the bottom of the half sole and heel extensions. These extensions are commonly referred to in the trade as buildups. Shoes with buildups are often worn by persons having one leg shorter than the other, and the height of the buildup is equal to the differential in the lengths of the legs. Additionally, buildups can be employed on both shoes to make the wearer appear taller than he or she actually is.

Heretofore, difficulty has been encountered in the manufacture of shoes incorporating buildups in the case where a flexible foam material, such as crepe rubber, is used. Because of the flexible nature of the crepe rubber and because the shoe is flexed to a considerable degree when walking, the bonding and securing means, such as glue and nails, tend to pull out thereby requiring repair of the shoes. This tends to dislodge, not only the buildup from the sole of the existing shoe, but also the secondary soles and heels which are nailed to the bottom surfaces of the buildups. Moreover, the crepe material is quite heavy, and people wearing large buildups on one or both shoes will experience foot and leg fatigue after an extended period of walking or at the end of the day.

SUMMARY OF THE INVENTION

In accordance with the present invention, the above difficulties and disadvantages of prior art shoe buildups are substantially overcome in the manufacture of platform shoes by the provision of buildups for the sole and heel portions of a platform shoe, wherein the buildups are constructed of rigid foam plastic material.

It has been found that this material provides firm support for the foot, particularly in the ball and heel areas, and is much lighter in weight than presently used wood and crepe rubber materials thereby reducing foot and leg fatigue after the shoes are worn for an extended period of time. Moreover, the foam material is easily attached to the main body of the shoe, as by any suitable adhesive material, and the foam material provides a good, long-lasting anchor for the nails which are utilized to attach the ground engaging soles and heels to the bottom surfaces of the buildups. The foam material also provides a firm surface for securing decorative side stripping on both the sole and heel buildups with better adhesion of such decorative stripping, and with a concomitant longer life for the shoe.

The method according to the present invention comprises the steps of: providing a shoe having an upper and a first sole member secured to the lower portion of the upper and wherein the first sole member has a lower surface, providing a block of rigid, lightweight foam material, shaping the block of foam material to conform generally to the shape of at least a portion of the lower surface of the sole member, attaching the shaped block of foam material to the lower surface of the sole member, and nailing either a ground engaging sole member or a ground engaging heel member, or both, to the lower surface of the shaped block.

The shoe according to the present invention comprises an upper having a lower portion; a first sole member secured to the lower portion of the upper, the sole member having a lower surface; a buildup comprising a shaped block of rigid, lightweight foam material secured to the lower portion of the first member, the buildup conforming generally in shape to at least a portion of the lower surface of the first sole member; and a ground engaging sole member or a ground engaging heel member, or both, nailed to the lower surface of the buildup.

It is an object of the present invention to provide a method of manufacturing platform shoes incorporating front and rear buildups utilizing a rigid, lightweight foam material which is economical to produce.

It is a further object of the present invention to provide a shoe buildup which is strong and rigid, yet sufficiently lightweight so that the occurrence of foot and leg fatigue is lessened when the shoes are worn for extended periods of time.

Yet another object of the present invention is to provide a shoe buildup made of a lightweight, economical material which provides a strong, durable anchor for the nails that are used to secure the ground engaging heel and sole to the buildup.

These and other objects of the present invention will become more apparent from a reading of the detailed description taken together with the appropriate drawings and figures.

DESCRIPTION OF THE PREFERRED EMBODIMENT

Figure 1:
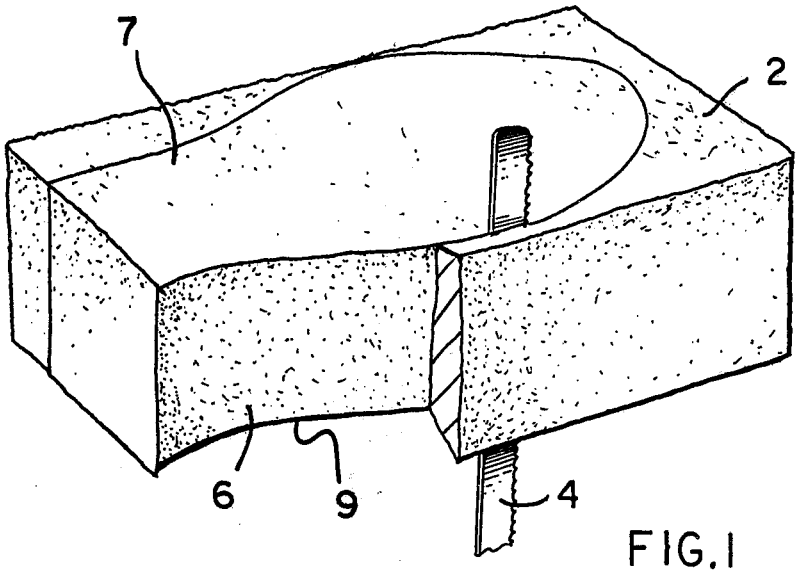
FIG. 1 is a perspective view showing the cutting of a rough shape of a sole buildup for a shoe from a block of rigid foam material.

Referring now to the drawings, and in particular FIG. 1, there is illustrated a block of lightweight, rigid foam plastic material 2 being cut by a reciprocating saw blade 4. A rough-cut buildup 6 is cut out of block 2, and it will be seen that the upper surface 7 of buildup 6 and the lower surface 9 generally have roughly the shape of the forward portion of a shoe sole. Block 2 is formed of a polyurethane foam material, which is readily available in a number of different forms and from a large number of manufacturers.

The removed rough-cut buildup 6 is rough ground by means of a standard cobbler's grinding wheel 8, which is driven by rotating shaft 11. This is utilized to conform the shape of the buildup 6 more closely to the shape of the forward portion of the shoe 10 illustrated in FIG. 3, but the buildup 6 need not yet be finish ground. The foam material, because it is very rigid and porous, can be easily ground to the desired shape without causing undue wear of the grinding wheel 8.

Figure 3:
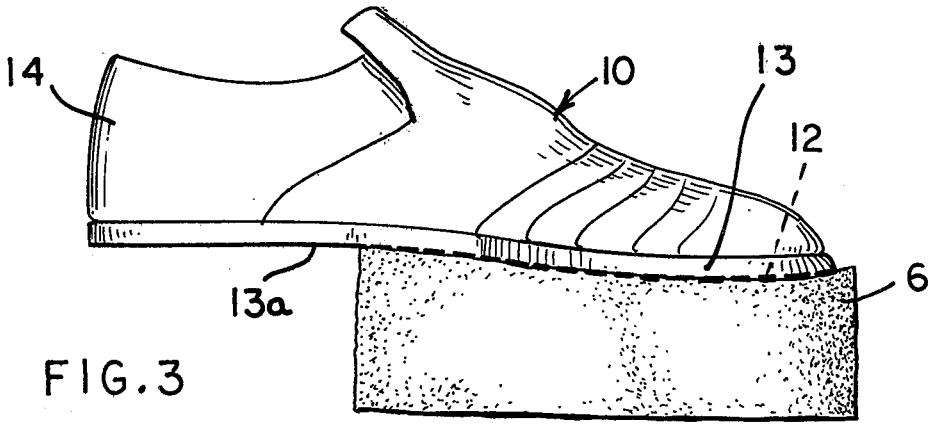
FIG. 3 is a side elevational view of a shoe having the buildup adhesively secured to the bottom thereof.

As illustrated in FIG. 3, when the buildup 6 has been rough ground to approximately the same shape as the lower surface of the sole 15 of shoe 10, it may be adhesively secured thereto by means of any appropriate adhesive 12, such as those commonly used in the shoe repair business to adhere materials of leather, nylon, and the like, together. In the case where the buildup 6 is being added to an existing shoe 10, all that is necessary is that the heel (not shown) be removed and the buildup 6 secured directly to the lower surface 13*a* of sole 13. In the case of new shoe construction, however, the buildup 6 can be secured directly to the welt (not shown). In either case, the term "sole" is intended to mean that layer of material which is secured either directly or indirectly to the shoe upper 14.

Figure 4:
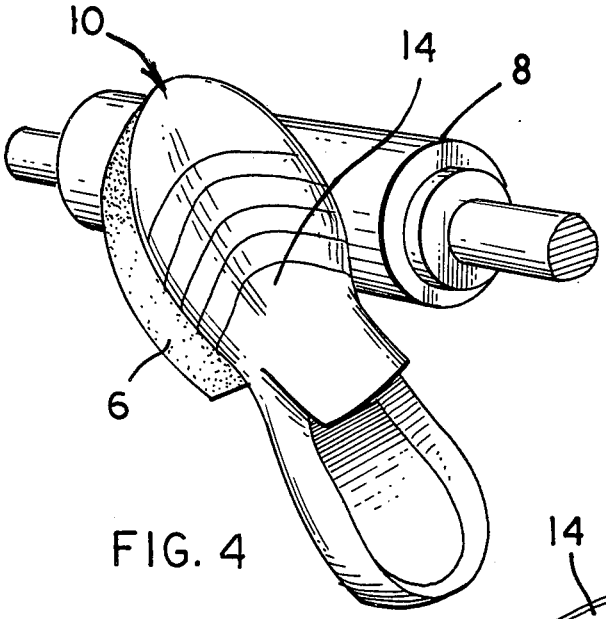
FIG. 4 is a perspective view illustrating the finish grinding of the sides of the buildup.
Figure 5:
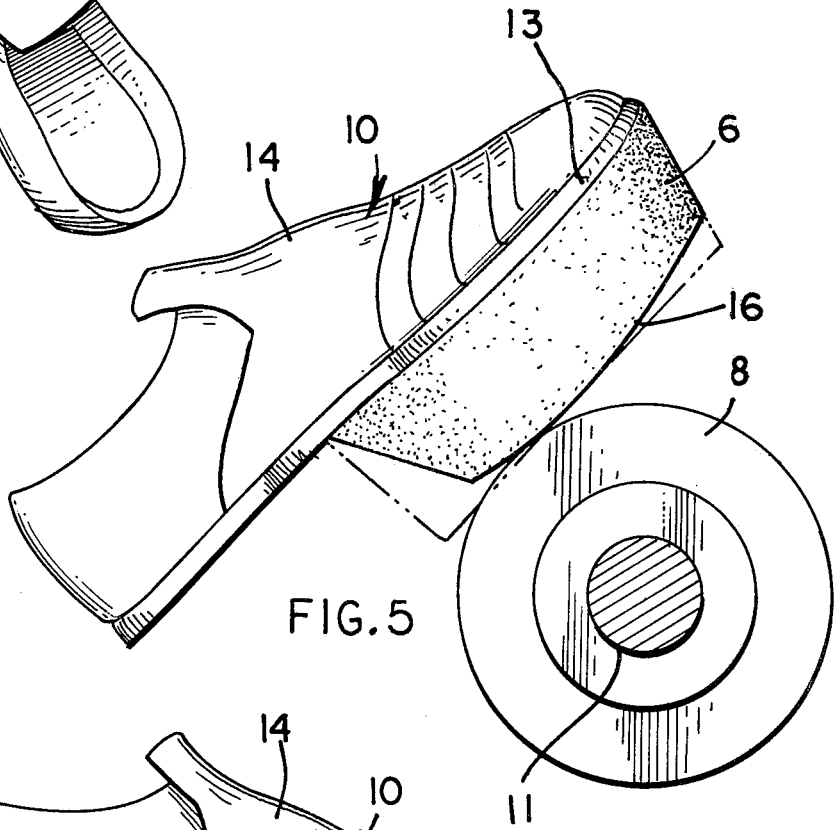
FIG. 5 is an elevational view illustrating the finish grinding of the bottom of the buildup.

Once the glue 12 has set, the sides of buildups 6 are finish ground by grinding wheel 8 as illustrated in FIG. 4. Since buildup 6 is already been attached to upper 14, it is a relatively simple matter to conform the shape of buildup 6 exactly to the shape of sole 13. The lower surface 16 of buildup 6 is then finish ground to the desired shape by grinding wheel 8 as illustrated in FIG. 5. Because the foam material is so cohesive, yet is easy to grind, the buildup 6 may be ground to virtually any desired shape.

Figure 2:
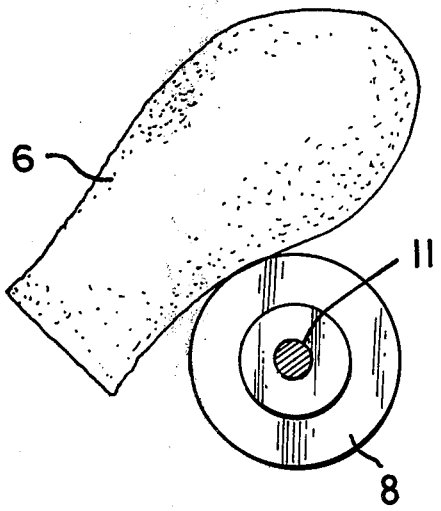
FIG. 2 illustrates the rough grinding of the buildup cut in FIG. 1.

The heel 18 (FIG. 6) for shoe 10 may be formed in the identical manner as buildup 6. Again, a block of rigid foam plastic material 2 is rough-cut to the general shape of the heel 18, rough ground by the same technique as illustrated in FIG. 2, glued to the lower surface 13*a* of sole 13, and then finish ground by the techniques illustrated in FIGS. 4 and 5.

Figure 6:
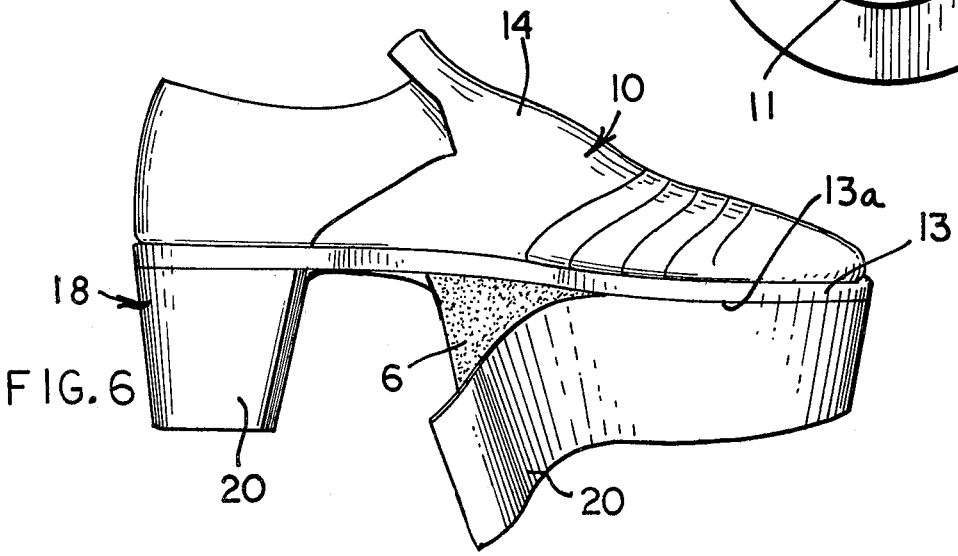
FIG. 6 is a side elevational view illustrating the shoe having both a heel and a sole buildup and wherein decorative covering material has been secured to the sides of the buildups.
Figure 7:
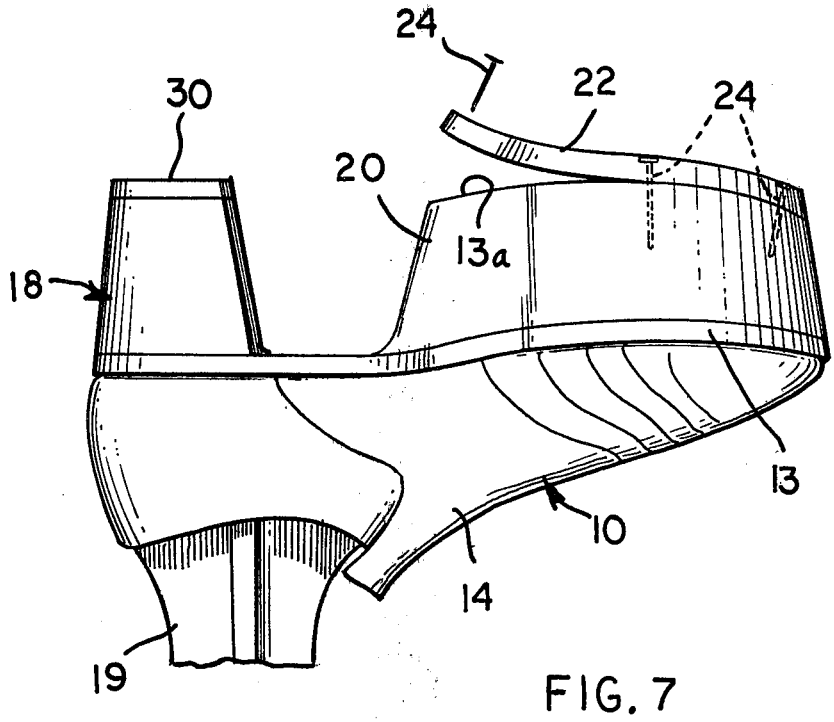
FIG. 7 is a side elevational view of the shoes in inverted position wherein a ground engaging heel has been nailed to the lower surface of the heel buildup, and wherein the ground engaging sole is being nailed to the bottom of the sole buildup.

Referring now to FIG. 6, the sole buildup 6 and heel buildup 26 are covered with a decorative outer covering material 20, such as leather, which is secured thereto by any suitable adhesive, such as that utilized to attach the buildups 6 and 26 to sole 13. The covering 20 not only gives the shoe a pleasing, finished appearance, but serves as a protective covering to prevent chipping or eroding of the foam material 6 and 26.

Figure 8:
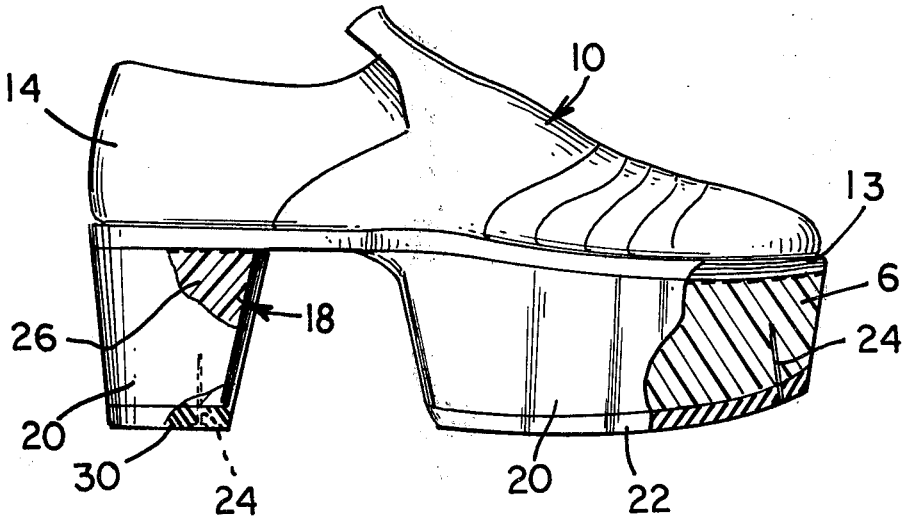
FIG. 8 is a side elevational view, partially in section, of the finished shoe.

Next, the shoe 10 is inverted and placed on a last 19, and a ground engaging sole 22 is secured to buildup 20 by driving cobbler's nails 24 through sole 22 and into the buildup 6, which provides a good anchoring material for the nails 24. Sole 22 may be made of any appropriate material, such as leather or nylon. Heel 30 is secured to the heel portion buildup 26 in the same manner, that is, by cobbler's nails 24. With the sole 22 and heel 30 attached, the shoe 10 is completed, and has the appearance illustrated in FIG. 8, wherein portions are broken away to illustrate the details of construction.

Although the method has been described in connection with a grinding wheel 8, hand sanding with medium grit sandpaper can also be used to shape the buildups 6 and 26.

The foam buildup material 2 can be made of any one of a variety of commercially available rigid polyurethane foams, such as polyurethanes of the type that are reacted with phtalate polyesters.

In accordance with one aspect of the present invention, and particularly batch type methods of preparing the rigid foam, two parts of a commercially available polyurethane No. 977-C-230, sold under that trade designation by Cook Industrial Coatings Company is mixed with one part of industrial component No. 977-C-3 & 4, sold under that trade designation by Cook Industrial Coatings Company. This contains diphenyl and menthane diisocyanate. The mixture is mixed in a galvanized container for approximately one minute, and this is sufficient to produce foaming of the mixture. The foamed mixture is left in a quiescent state for thirty to forty-five minutes, and then removed from the container. The block of material is then sawn and abraded as described above.

As an alternative to the method of forming a large block of material and then cutting the rough shape of the buildup therefrom, the buildups can also be formed by pouring the reactive polyurethane and catalyst materials into individual molds having the shape of the buildups. Whereas this would be more feasible from the standpoint of large scale manufacturing, it is believed that the method of cutting the buildups from a block is more suited to the shoe repair industry.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. A method for the manufacture of a shoe comprising:

providing a shoe having an upper and a first sole member secured to the lower portion of the upper, said sole member having a lower surface, providing a block of rigid, lightweight foam material, shaping the block of foam material to conform generally to the shape of at least a portion of the lower surface of the sole member, attaching the shaped block of foam material to the lower surface of the sole member, said shaped block having a lower surface, and nailing one of a ground engaging second sole member and ground engaging heel member to the lower surface of said shaped block.

2. The method of claim 1 wherein the shaped block is formed by first cutting the block of foam material to a rough shape approximating the shape of the first sole member, and then the rough shaped block is abraded until the final shape of the shaped block is achieved.

3. The method of claim 2 wherein the final shape of the shaped block is in part formed by abrading the shaped block after it has been attached to the first sole member.

4. The method of claim 1 including: providing a second shaped block conforming to the shape of another portion of the first sole and having a lower surface, attaching the second shaped block to the lower surface of the sole member, and nailing the other of the ground engaging second sole member and a ground engaging heel member to the lower surface of the second shaped block.

5. The method of claim 1 wherein said block of rigid foam material is a polyurethane foam material.

6. The method of claim 1 wherein the shaped block includes sides, and including the step of securing a decorative outer covering to the sides of the shaped block.

7. The method of claim 1 wherein the shaped block is adhesively secured to the lower surface of the first sole member.

* * * * *